US006691447B1

(12) United States Patent
Otteman

(10) Patent No.: US 6,691,447 B1
(45) Date of Patent: Feb. 17, 2004

(54) NON-TELESCOPING RIFLESCOPE ADJUSTMENT MECHANISM

(75) Inventor: Rodney H. Otteman, Aloha, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 10/246,505

(22) Filed: Sep. 17, 2002

(51) Int. Cl.[7] ..... F41G 1/38
(52) U.S. Cl. ..... 42/122; 42/129; 359/429
(58) Field of Search ..... 42/119, 120, 122, 42/129; 359/429

(56) References Cited

U.S. PATENT DOCUMENTS

| | | | | |
|---|---|---|---|---|
| 2,143,167 A | | 1/1939 | Pechar | |
| 2,165,796 A | | 7/1939 | Humeston | |
| 2,208,913 A | | 7/1940 | Unertl | |
| 2,229,637 A | | 1/1941 | Burton | |
| 2,336,107 A | | 12/1943 | Litschert | |
| 2,583,042 A | | 1/1952 | Dayton | |
| 2,913,826 A | | 11/1959 | Petty | |
| 3,037,287 A | | 6/1962 | Glatz et al. | |
| 3,058,391 A | | 10/1962 | Leupold | 88/32 |
| 3,297,389 A | | 1/1967 | Gibson | 350/10 |
| 3,826,012 A | | 7/1974 | Pachmayr | |
| 3,990,155 A | | 11/1976 | Akin, Jr. et al. | |
| 4,038,757 A | | 8/1977 | Hicks et al. | |
| 4,200,355 A | | 4/1980 | Williams, Jr. | 350/10 |
| 4,247,161 A | | 1/1981 | Unertl, Jr. | 350/10 |
| 4,373,269 A | | 2/1983 | Doliber et al. | |
| 4,389,791 A | * | 6/1983 | Ackerman | |
| 4,643,542 A | | 2/1987 | Gibson | 350/562 |
| 5,363,559 A | | 11/1994 | McCarty | |
| 5,513,440 A | | 5/1996 | Murg | |
| 6,279,259 B1 | | 8/2001 | Otteman | 42/122 |
| 6,351,907 B1 | | 3/2002 | Otteman | 42/120 |

FOREIGN PATENT DOCUMENTS

| | | |
|---|---|---|
| DE | 297 20 737 U1 | 3/1998 |
| GB | 598306 | 2/1948 |
| GB | 2213959 | 8/1989 |

* cited by examiner

*Primary Examiner*—Stephen M. Johnson
(74) *Attorney, Agent, or Firm*—Stoel Rives, LLP

(57) ABSTRACT

A non-telescoping adjustment mechanism for adjustment of a riflescope or other sighting device includes a core that is rotatable about a central axis of the adjustment mechanism and an adjustment knob, which is rigidly coupled to the core and which extends from a housing of the riflescope to a protrusion distance. Rotating the adjustment knob causes the core to rotate for adjusting an adjustable member within the riflescope. An index slide, threadably coupled to the adjustment knob, reciprocates along the central axis between the adjustment knob and the core in response to rotation of the adjustment knob. A scale, positioned on the adjustment mechanism, provides a visual indication of the degree of adjustment applied to the riflescope through multiple turns of the adjustment knob. The indication is achieved without increasing the protrusion distance of the adjustment knob.

24 Claims, 6 Drawing Sheets

NON-TELESCOPING RIFLESCOPE ADJUSTMENT MECHANISM

TECHNICAL FIELD

The present invention relates to adjustment mechanisms for sighting devices such as riflescopes and, in particular, to a non-telescoping adjustment mechanism, including a scale that indicates the number of rotations of the adjustment mechanism.

BACKGROUND OF THE INVENTION

Riflescopes have long been used in conjunction with firearm, such as rifles and handgun to allow a shooter to accurately aim the firearm. Because bullet trajectory, wind conditions, and distance to the target can vary depending upon shooting conditions, quality riflescopes typically provide compensation for variations in these conditions by allowing a shooter to make small adjustments to the optical characteristics or the aiming of the riflescope relative to the firearm on which it is mounted. These adjustments are known as holdover (also called "elevation") and windage, and are typically accomplished by lateral movement of an adjusting member, such as a reticle located within the riflescope, as shown in U.S. Pat. No. 3,058,391 of Leupold, or pivotal movement of lenses mounted to a pivot tube within a housing of the riflescope to divert the optical path of the observed light before it reaches the reticle, as shown in U.S. Pat. Nos. 3,297,389 and 4,408,842 of Gibson. In these designs, a shooter accomplishes adjustment of windage and holdover by way of two laterally protruding adjustment knobs or adjustment screws, typically extended at right angles to each other, that are operatively connected to the adjusting member. A spring located between the housing and the adjusting member opposite the adjustment knobs biases the adjusting member against the adjustment knobs so that the adjusting member follows the movement of plunger screws of the adjustment knobs. The adjustment knobs may be sealed to the housing to maintain a nitrogen gas charge within the interior of the housing to prevent fogging and condensation on internal lens surfaces. The plunger screws typically include very fine threads and the adjustment knobs are rotatable through multiple rotations to allow precise adjustments.

An index mark on the housing of the riflescope provides a reference by which a shooter may read a scale marked around the circumference of the adjustment knob. The shooter typically adjusts windage and elevation so that a bullet will hit a target at a particular known reference distance, e.g., 100 yards, when an aiming mark of the reticle is centered on the target viewed through the riflescope. This process is known as "sighting in." When the shooter wants to shoot at a target at a different distance, e.g., 200 yards, or under different wind conditions, the shooter rotates the holdover and windage adjustment knobs a known amount to accurately place the aiming mark for the target. Some scopes provide a mechanism for adjusting the angular position of the scale on the knob independently of the actual windage or holdover adjustment so that the shooter can align the zero mark of the scale with the index mark on the outer tube after the rifle has been sighted in at the reference distance. The shooter can then easily return to the sighted-in windage and holdover positions. However, a scale around the circumference of the adjustment knob only indicates rotation of less than 3600 and does not provide the shooter with an indication of the number of rotations of the knob.

Some adjustment mechanisms are telescoping, i.e., they extend along their axis of rotation as they are rotated. U.S. Pat. No. 2,165,796 of Humeston describes such an adjustment mechanism that extends outwardly from the riflescope and that includes a cup-shaped cap having an inwardly depending skirt. The cap, which drives an adjustment screw, is manually rotatable about a cylindrical sleeve having transverse markings along its length. As the cap is rotated, it moves/extends longitudinally with the adjustment screw so that an inward edge of the skirt moves along the transverse markings on the sleeve to indicate the number of rotations. A click mechanism comprising a detent post, around which a detent finger of the cap rides, provides an audible or tactile indication for every increment of rotation of the cap. The shooter thus need not take his or her eye from the target to make fine adjustments to windage or holdover. Telescoping adjustment mechanisms of this type are not easily sealed to the housing of the riflescope. Furthermore, when extended, they tend to catch on clothing of the shooter, on vegetation, or other protruding items and are thus easily damaged. Further, because the adjustment screw is directly connected to the cap, the amount of longitudinal movement of the adjustment screw per rotation of the cap determines the desired spacing of the transverse markings. If the adjustment screw includes very fine threads to allow minute adjustments to windage and holdover, the longitudinal movement of the screw and cap will be so small, and the transverse markings so closely spaced, that it will be difficult to determine the exact number of complete rotations by viewing the position of the edge of the cap along the transverse scale.

In many of the prior art aiming devices, a rotating adjustment screw bears directly on the adjusting member. Any out-of-roundness of the bearing end of the adjustment screw will cause undesirable fluctuations in the sighting of the aiming device. Any roughness or non-planarity of the bearing end of adjusting member will cause deviations in the sight's aim as the adjustment screw is rotated and different regions of its bearing end press against the adjusting member. Moreover, friction between the rotating adjustment screw and the adjusting member can cause wear on both parts where they contact. Such wear can further degrade the performance of the adjustment mechanism and can cause small particles to dislodge and affect the optics of the riflescope.

Many prior art adjustment knobs are also permanently installed in a housing of the riflescope and cannot be changed in the field without damaging the riflescope or breaking the gas-tight seal that maintains a nitrogen gas charge within the housing.

A need exists for an improved adjustment mechanism that allows a shooter to easily and accurately determine the extent of adjustment through multiple rotations of the mechanism by way of a scale on the exterior of the mechanism, while maintaining an optimal length of the mechanism for gripping and for viewing of the scale.

SUMMARY OF THE INVENTION

In accordance with the present invention, a non-telescoping adjustment mechanism is provided for making adjustments in a riflescope or other aiming or sighting device, such as a laser sight or theodolite. In a preferred embodiment, a riflescope with a non-telescoping adjustment mechanism includes a housing having an interior and an exterior, and an adjustable member that is movably mounted within the interior of the housing for making elevation and/or windage adjustments to the aim of the riflescope. The adjustment mechanism includes a core that is rotatable about a central axis of rotation of the adjustment mechanism and supported by the housing, an adjustment plunger that is threadably coupled to the core, and an adjustment knob. To adjust the adjustment mechanism, the shooter turns the adjustment knob. The core is rigidly connected to the adjustment knob for rotation therewith and restricted from moving along the axis of rotation relative to the housing of the riflescope. Rotation of the core causes the adjustment plunger to move relative to the core along the axis of rotation, thereby operatively engaging the adjustable member and causing the adjustable member to move. The adjustment mechanism extends through an opening of the housing to operatively engage with the adjustable member within the housing, while being manually adjustable from outside the housing.

Upon rotation of the adjustment knob (and the core therewith), the adjustment plunger extends within the interior of the housing through an opening, without changing the distance by which the adjustment knob protrudes from the housing (i.e., a non-telescoping adjustment, externally). A gas-impermeable seal surrounds the opening of the housing and is positioned between the housing and the core to seal the interior of the housing, thereby preventing fogging and condensation on optical surfaces within the housing. In an alternative embodiment, the core and plunger are reversed so that the core extends within the interior of the housing through the opening in response to rotation of the adjustment knob, thereby causing movement of the adjustable member. In such an embodiment, the gas-impermeable seal may be positioned between the housing and the adjustment plunger.

An index slide is threadably coupled to the adjustment knob and slidably guided along a longitudinal slot for movement, along a slide path that extends along the axis of rotation between the adjustment knob and the core, in response to rotation of the adjustment knob. In a preferred embodiment, the index slide is a tube that is keyed, either directly or indirectly, to a slot in the housing or another non-rotating component of the adjustment knob, to thereby rotationally restrict the tube, causing it to move along a substantially linear path along the axis of rotation in response to rotation of the adjustment knob.

When the shooter adjusts for windage and holdover, a datum, such as the inwardly depending edge of the adjustment knob, moves along a scale, which may include a set of indicia positioned on the index slide and spaced apart along the axis, for example. The direction of relative movement of the scale and the datum is along the axis of rotation. The scale and the datum cooperate so that their relative movement provides a visual indication of the amount of rotation of the core, such that the shooter can determine the number of turns through which the adjustment mechanism has been rotated.

Additional aspects and advantages of this invention will be apparent from the following detailed description of preferred embodiments thereof, which proceeds with reference to the accompanying drawings.

DETAILED DESCRIPTION OF PREFERRED EMBODIMENTS

Figure 1:
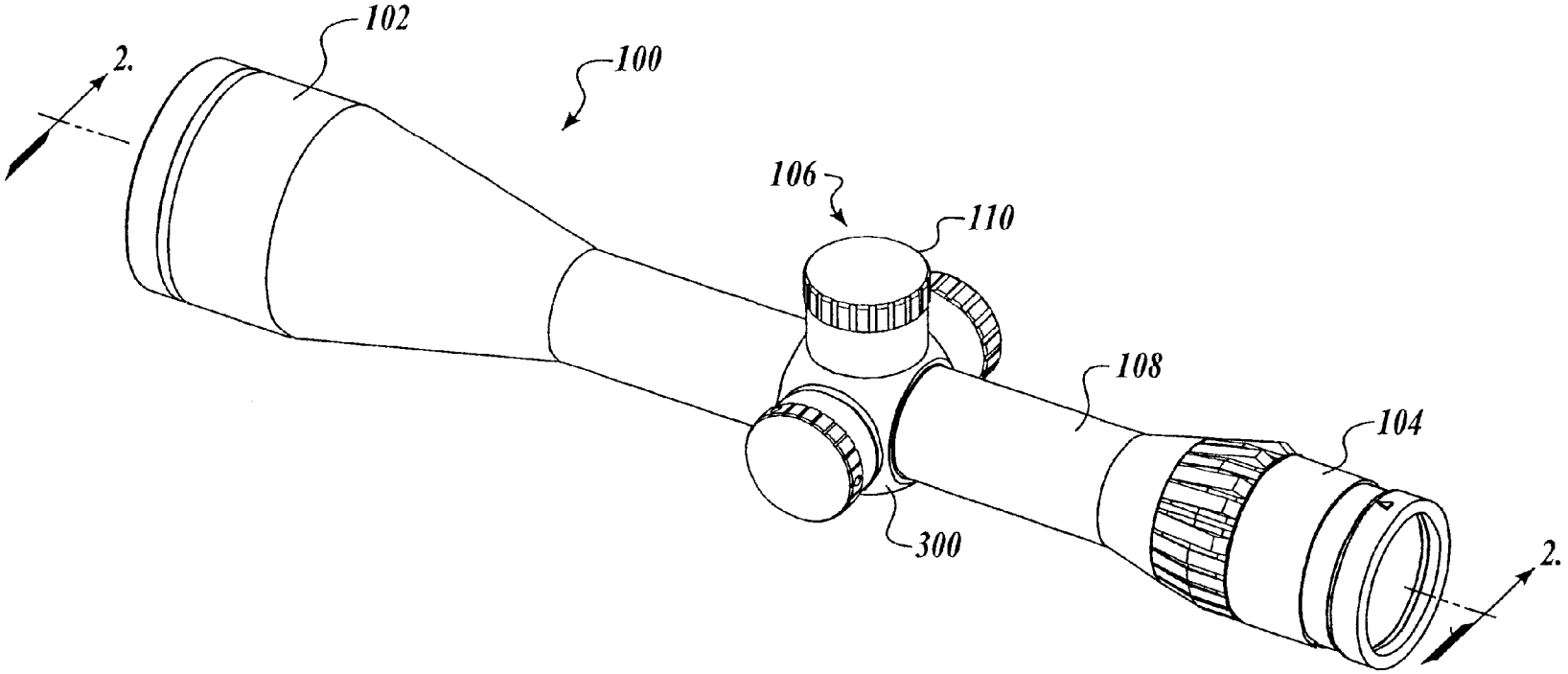
FIG. 1 is a perspective view of a riflescope including an adjustment mechanism in accordance with the invention.

In general, riflescopes include an outer substantially cylindrical tube, with outwardly flared opposite ends. For example, FIG. 1 is a perspective view of a riflescope 100 that has an outer tubular housing 108 with a flared objective end 102 and a flared eyepiece end 104. An adjustment mechanism 106 is located proximate the midpoint of riflescope 100 and is shown with a dust cover 110 installed. The riflescope 100 is mountable to a firearm, rifle, or handgun (not shown). Those skilled in the art will appreciate that the shape of the riflescope 100 and the position of the adjustment mechanism 106 along the length of the riflescope 100 are matters of mere design choice and may be different from the shape and positioning shown in FIG. 1.

Figure 2:
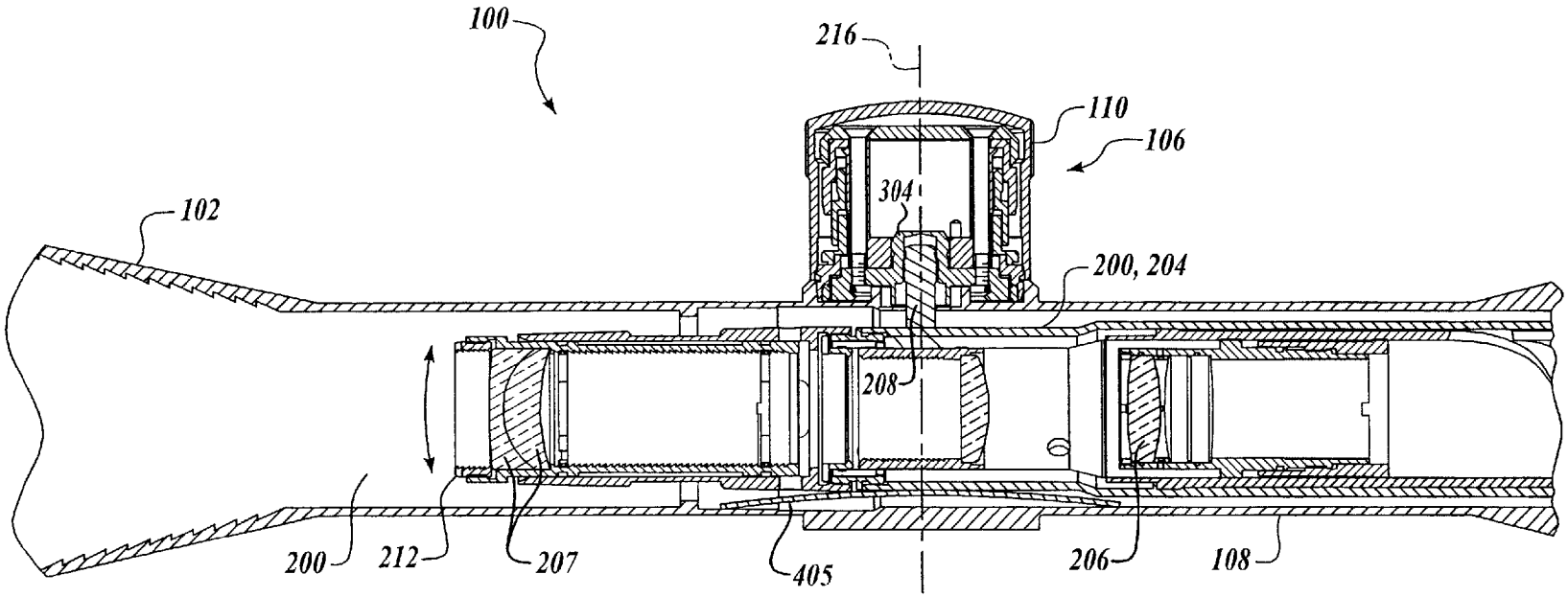
FIG. 2 is an enlarged partial cross-sectional view of the adjustment mechanism and riflescope of FIG. 1 taken along line 2—2 of FIG. 1, showing the adjustment mechanism acting on an adjustable member in accordance with the present invention.

FIG. 2 is an enlarged partial cross-sectional view of the riflescope 100 and adjustment mechanism 106 of FIG. 1, taken along line 2—2 of FIG. 1. With reference to FIG. 2, the adjustment mechanism 106 is shown acting on an internal adjustable member 200 disposed within the housing 108. The adjustable member 200 is movably mounted within an interior 202 of the housing 108, and its movement is controllably actuated by the adjustment mechanism 106, as explained herein below. The adjustable member 200 is preferably an erector tube 204 that includes an erector lens assembly 206, an optical power adjustment lenses 207, and a reticle or aiming mark (not shown). The erector tube 204 is pivotably mounted to the housing 108, for example, by means of a ball-type joint (not shown) near the eyepiece end 104 of the housing 108. Alternative adjustable members may include reticles, lenses, range-finding devices, electronic circuits, combinations of one or more of these, and any other adjustable component of an aiming system.

In accordance with the invention, there is provided a non-telescoping adjustment mechanism for a riflescope or other aiming device, that is useful for all types of weapons and other aiming uses, but for ease of description the following text refers mainly to rifles and riflescopes. In the field, such a non-telescoping adjustment mechanism provides significant enhancement in utility. Moreover, the invention may also have a non-visual feedback mechanism, such as a detent mechanism, which provides an audible or tactile "click," or both, to facilitate adjustment for elevation and windage, as further described below.

The following description relates to a first preferred embodiment of the invention, with reference to FIGS. 1–4. Briefly, the adjustment mechanism 106 in accordance with the invention includes a control assembly 301 that the user manually adjusts; a plunger mechanism 303, coupled to the control assembly 301, that reciprocates when the control assembly 301 is adjusted; and an optional detent mechanism 305. Each of these are discussed in detail below.

Figure 3:
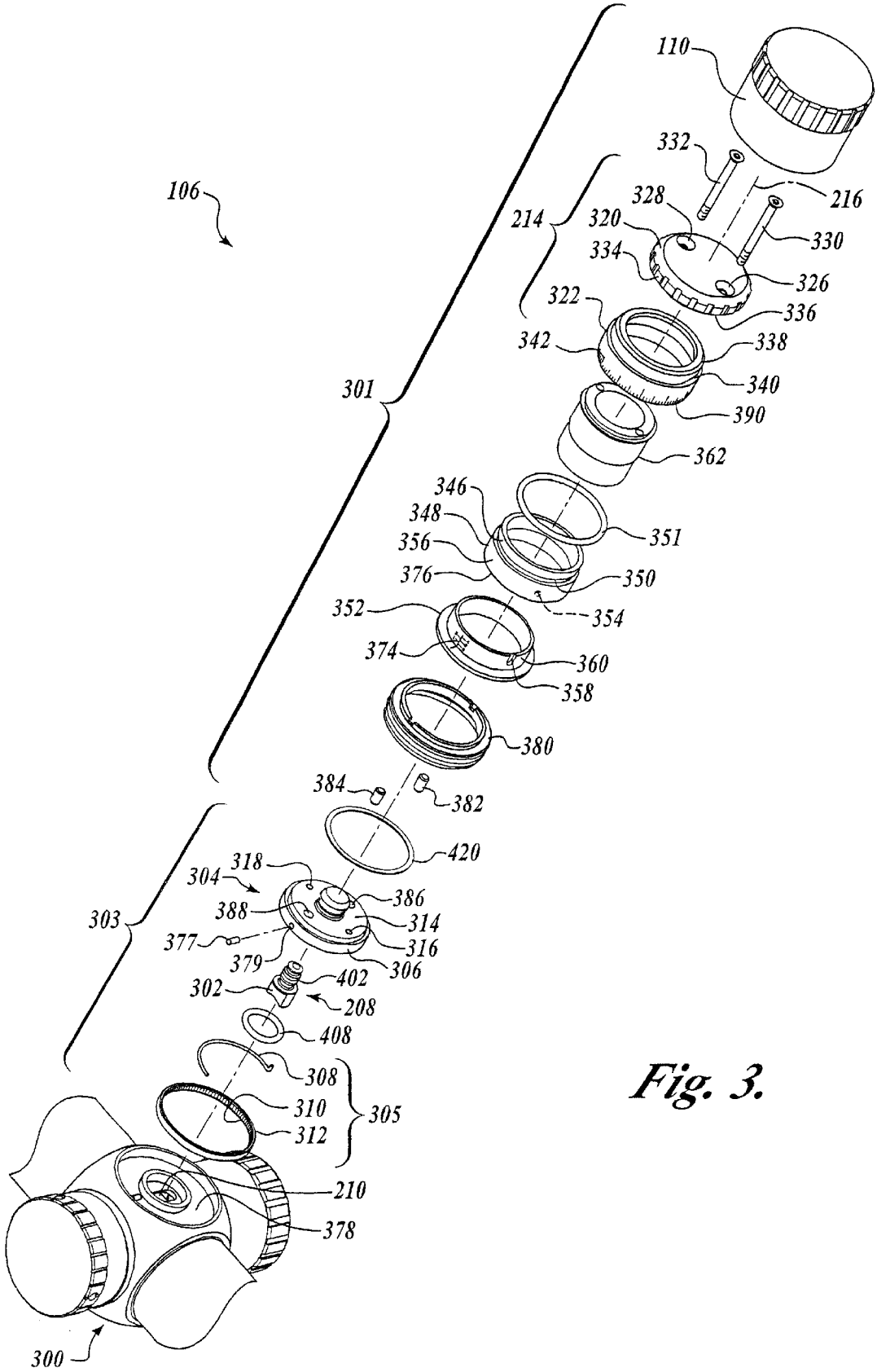
FIG. 3 is an exploded view of the adjustment mechanism of FIGS. 1 and 2, including a turret portion of the riflescope.

FIG. 3 is an exploded view of adjustment mechanism 106 of the first preferred embodiment and a turret section 300 of the housing 108 of riflescope 100. FIG. 3 shows detail of the components of the control assembly 301, the plunger mechanism 303, and the detent mechanism 305.

Figure 4:
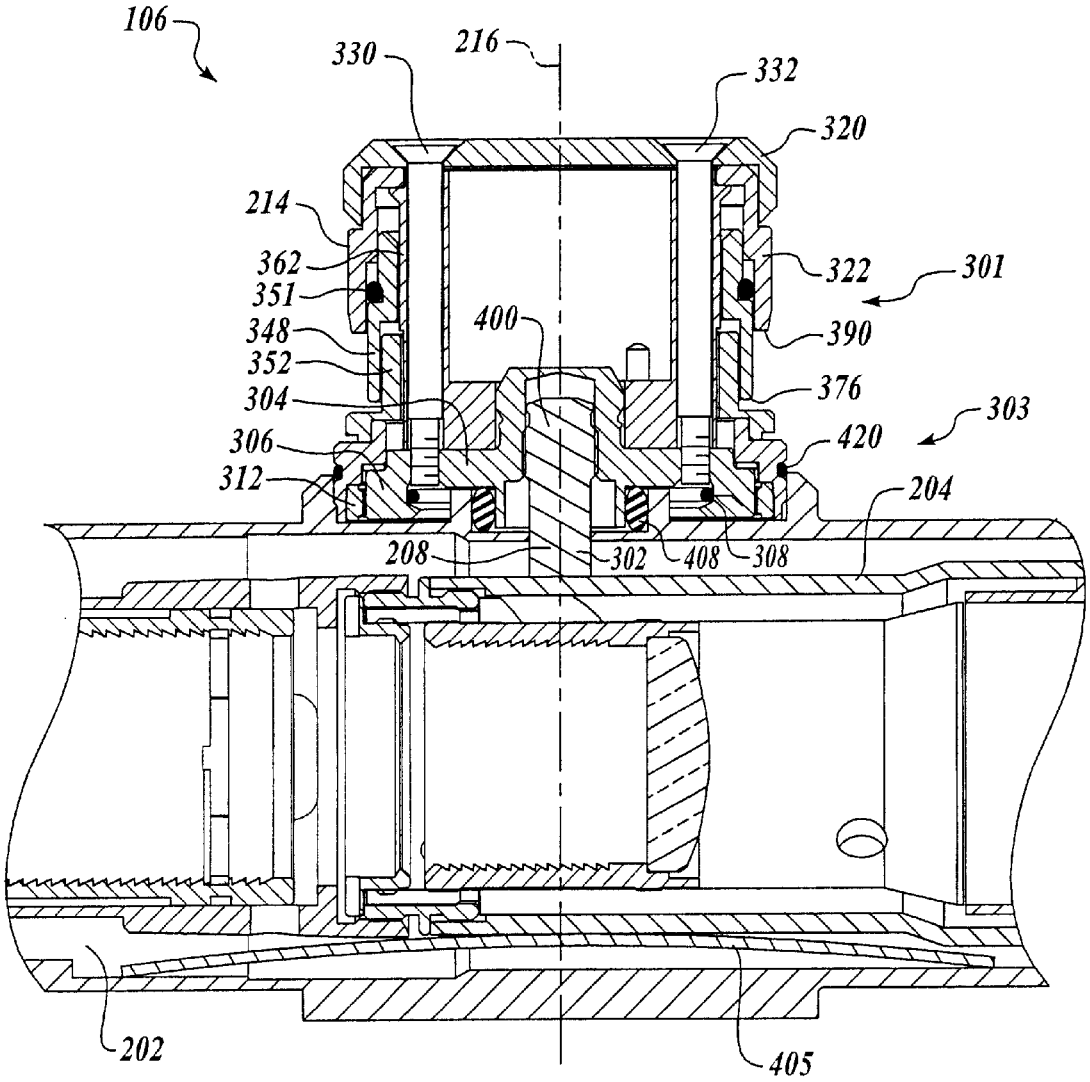
FIG. 4 is an enlarged cross-sectional view of the riflescope and adjustment mechanism of FIG. 2.

The control assembly 301 is coupled to an adjustment plunger 208, as explained more fully below, that is able to reciprocate along a central axis 216 of the adjustment mechanism 106 and thereby urge, with its lower working end 302, the adjustable member 200 to controllably adjust the riflescope optics. While parts of the control assembly 301 rotate around the central axis 216, the adjustment plunger 208 is prevented from rotation so that the adjustment plunger 208 is linearly displaced in response to adjustment of the control assembly 301. In accordance with the invention, further described below, adjustment of the control assembly 301 does not cause the adjustment mechanism 106 to grow outwardly from the housing 108. In other words, the adjustment mechanism 106 extends from the housing a fixed protrusion distance, which does not change when the control assembly 301 is adjusted. To better appreciate these features, reference is made to FIG. 4, in addition to the exploded view of FIG. 3 discussed above. FIG. 4 shows an enlarged view of the riflescope 100 and adjustment mechanism 106 of FIG. 2, with the dust cover 110 omitted for clarity.

Referring to FIGS. 3 and 4, it will become apparent how the plunger mechanism 303 controls the riflescope optics when the control assembly 301 is adjusted. As shown, an upper threaded end 400 of the adjustment plunger 208 includes external drive threads 402 that mesh with internal drive threads (not shown) of a core 304. The core 304 is mounted to rotate about the central axis 216 of the adjustment mechanism 106. The core 304 is coupled to an adjustment knob 214 of the control assembly 301 by a pair of mounting fasteners 330 and 332 that extend through mounting holes 326 and 328 of the adjustment knob 214 and into two threaded holes 316 and 318 in upper surface 314 of core 304. As a result, rotation of the adjustment knob 214 causes the core 304 to rotate in concert therewith. The adjustment plunger 208, which extends from the core 304 inwardly of the housing 108 and which is threadingly connected to the core 304, does not rotate along with the core 304. Instead, since the adjustment plunger 208 has a lower end 302 with at least one flat side that is keyed to a slot 210 in the riflescope housing 108, the adjustment plunger 208 cannot rotate in the slot 210; rather, it reciprocates in the slot 210 along central axis 216 to urge against a free end 212 of the erector tube 204, thereby adjusting the riflescope optics for windage or holdover.

Typically, a leaf spring 405 or other biasing device may be positioned within the interior 202 of the housing 108 to bias the erector tube 204 toward the adjustment plunger 208, so that when the adjustment plunger 208 urges against the erector tube 204, the erector tube 204 controllably moves to adjust the riflescope optics for windage and holdover adjustment. However, the adjustment mechanism 106 of the present invention could readily be adapted to adjust components of an aiming device different from the erector tube of a riflescope, including adjustments affecting other than windage and holdover.

The adjustment knob 214, a component of the control assembly 301, includes a retaining cap 320 and a dial 322. As shown in FIGS. 2 and 3, retaining cap 320 includes a cylindrical gripping surface 334 with a lower edge 336. The gripping surface 334 may be notched, fluted, knurled, or otherwise textured to provide a surface for the user to grip when manually rotating the adjustment knob 214. The dial 322 is preferably shaped as a ring, but could, alternatively, be a solid cylindrically shaped part (not shown). The gripping surface 334 of the retaining cap 320 fits over an upper portion 338 of the dial 322, and the lower edge 336 of the retaining cap 320 rests on a lip 340 formed around the upper portion 338 of the dial 322. The lower edge 336 of the retaining cap 320 frictionally engages the lip 340 of the dial 322 when the mounting fasteners 330 and 332 are tightened, thereby causing the dial to rotate with the retaining cap without slippage.

The dial 322 may be supplied with a fine scale composed of parallel longitudinal indicia 342 spaced apart around the circumference of the dial 322 to facilitate fine adjustments, i.e., rotation of the adjustment knob 214 in increments of less than 360° degrees. In an alternative embodiment (not shown), the dial 322 and retaining cap 320, which together in the illustrated embodiment of the present invention form the adjustment knob 214, are fabricated as a single unitary part, rather than as separate components.

The foregoing has explained how the adjustment knob 214 is coupled to the adjustment plunger 208 via the core 304 to adjust the optics of the riflescope 100. The following is a discussion of the non-telescoping rotation-indicating feature of the invention. The dial 322 of the adjustment knob 214 includes internal indexing threads (not shown) with which external indexing threads 346 of an index tube 348 are engaged. The index tube 348 is prevented from rotating relative to the housing 108 by keying the index tube 348 to an annular flange 352. Annular flange 352 is press fit onto a mounting nut 380 that is securely threaded to the housing 108. The annular flange 352 is sleeved by a portion of the index tube 348, and a dimple or keying pin 354 of the index tube 348 protrudes inwardly from a lower portion 356 of the index tube 348 to slidably seat within a longitudinal slot 358 formed in an outer surface 360 of the annular flange 352. In this keyed arrangement, manual rotation of the adjustment knob 214 and its threaded engagement with the index tube 348 causes the index tube 348 to reciprocate along a slide path coincident with the axis 216, rather than rotate, because keying pin 354 is constrained to slide along longitudinal slot 358. In another embodiment (not shown) the keying pin and longitudinal slot are reversed so that the keying pin is rigidly mounted to the annular flange 352 and the longitudinal slot is formed in the index tube 348. Alternatively, the index tube 348 may be prevented from rotating by other means (not shown), such as by keying it directly to the housing 108 or another non-rotating component of the adjustment knob 214.

In yet further alternative embodiments (not shown), the index tube 348 is substituted with an index slide that is threadably coupled to the dial 322 in the manner of a worm gear mechanism. The index slide fits slidably within a longitudinal slot in the annular flange 352, which guides the index slide for movement along the axis of rotation in response to rotation of the adjustment knob 214.

As shown in FIG. 3, an optional spacer 362, is sized to pass through a central bore of the index tube 348 between adjustment knob 214 and core 304 to improve the torsional and lateral rigidity of the adjustment mechanism 106. A pair of positioning pins 382 and 384 fit in a pair of respective alignment holes 386 and 388 of core 304 and extend into spacer positioning holes (not shown) on the bottom of the spacer 362 to help align the entire mechanism during assembly and to further improve torsional and lateral rigidity.

The invention allows a user to visually determine how many turns of the adjustment knob 214 have been made in adjusting the riflescope. A scale 374 comprises a set of transverse indicia (FIGS. 5–7) provided on adjustment mechanism 106, which are used to measure the position of index tube 348 along axis 216 as adjustment knob 214 is turned.

Figure 5:
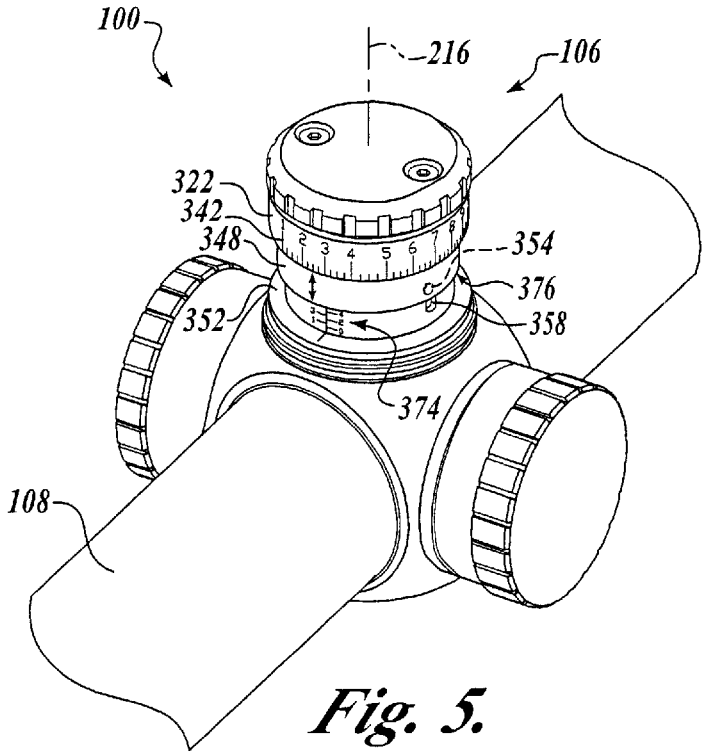
FIG. 5 is an enlarged perspective view of the adjustment mechanism of FIGS. 1–4, with a dust cap of the mechanism omitted to show detail of a scale for determining the number of turns of the adjustment knob, in accordance with a first preferred embodiment.

FIG. 5 is an enlarged pictorial view of the adjustment mechanism 106 of FIGS. 1–4, with the dust cover 110 omitted to show detail of scale 374. With reference to FIG. 5, the indicia of scale 374 are placed on the surface 360 of annular flange 352 to extend transversely of the central axis 216 in a longitudinally spaced arrangement along the axis 216. A lower edge 376 of the index tube 348 serves as a datum. Reciprocal movement of the index tube 348 exposes more or less of the scale 374 beyond the lower edge 376, thereby indicating to the user the extent of adjustment applied to the riflescope.

Figure 6:
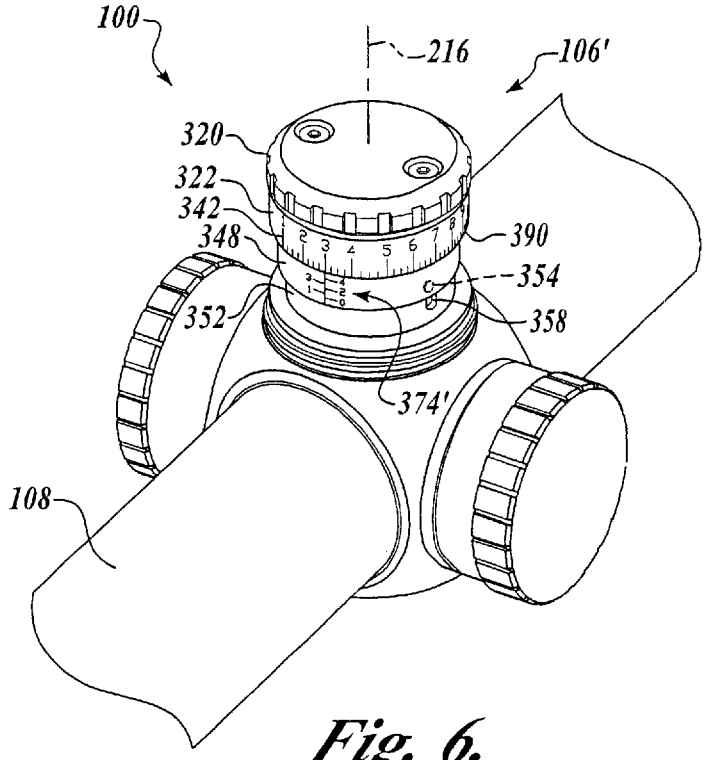
FIG. 6 is an enlarged perspective view of a second preferred embodiment adjustment mechanism in accordance with the invention.

FIG. 6 is an enlarged pictorial view of a second preferred embodiment adjustment mechanism 106' showing an alternative configuration of the scale and datum of FIG. 5. With reference to FIG. 6, the scale 374' is marked on the lower portion 356 of the index tube 348, while a lower edge 390 of dial 322 serves as the datum.

Figure 7:
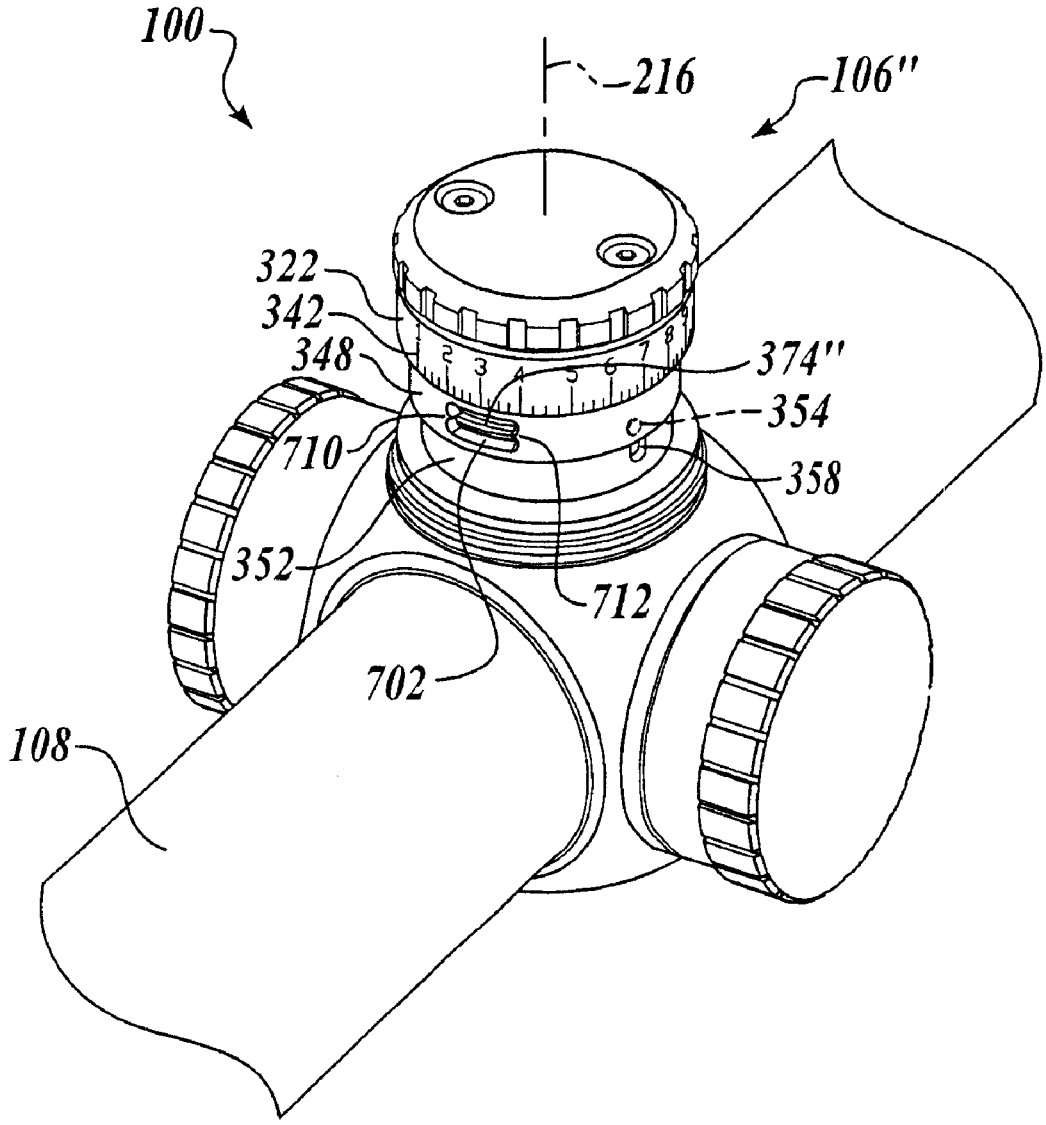
FIG. 7 is an enlarged perspective view of an third preferred embodiment adjustment mechanism in accordance with the invention.

A third preferred embodiment adjustment mechanism 106" is shown in FIG. 7. With reference to FIG. 7, index tube 348 includes a window 702, formed as a cutout or portion of transparent material, through which the user can view scale 374" on the flange 352. A datum is formed by a pair of pointers 710 and 712 located opposite each other along the side edges of window 702. In an alternative embodiment (not shown), the datum could be a reference line inscribed in a transparent material in window 702.

In yet other embodiments (not shown), the scale 374 is supplied on an exterior surface of the core 304, the adjustment plunger 208, or the housing 108, and the datum is supplied on the index tube 348, adjustment knob 214, or flange 352. Generally, the positions of the datum and scale may also be reversed. The datum is positioned in a location capable of indicating visually the relative movement between the index tube 348 and another component of the riflescope 100 or adjustment mechanism 106.

A further alternative (not shown) involves a dial having an outer diameter smaller than an inner diameter of the index tube so that the dial slides and rotates within the index tube. In this alternative embodiment, the dial includes outer indexing threads that mate with inner indexing threads of the index tube. In this embodiment, the scale can be marked on the dial and an upper edge of the index tube can serve as the datum.

In a secondary aspect of the invention, the indexing threads 346 of the index tube 348 and the dial 322 are cut finer, i.e., with a smaller pitch, than drive threads 402 of the core 304 and adjustment plunger 208 (FIGS. 3 and 4). The differential thread pitch facilitates faster displacement of the erector tube 204 when the adjustment knob 214 is rotated, while minimizing both the travel of the index tube 348 and the overall length of the control assembly 301 along the axis 216. Alternatively, the indexing threads 346 of the dial 322 and index tube 348 may be cut more coarsely, i.e., with greater pitch, than the drive threads 402 of the core 304 and adjustment plunger 208, thereby allowing for more precise control of holdover and windage adjustment while amplifying such adjustment in the scale 374 of the adjustment mechanism 106.

With reference to FIGS. 3 and 4, an optional detent mechanism 305 provides tactile and/or audible "clicks" as feedback to the user when the adjustment knob 214 is turned. Example detent mechanisms useful in connection with the present invention are shown and described at column 4, lines 16–22 of U.S. Pat. No. 6,279,259, titled Rifle Scope Adjustment Mechanism, issued Aug. 28, 2001, and in U.S. patent application No. 09/917,061, titled "Adjustable Rifle Scope With Radial Detents," filed Jul. 27, 2001, both of which are hereby incorporated by reference. The detent mechanism 305 provides a useful sensory input to the user, such that the user can determine the extent of an adjustment without averting his or her eye from a target viewed through riflescope 100. Other non-visual feedback mechanisms such as electronic audio and tactile feedback mechanisms are also considered to fall within the scope of the present invention.

With reference to FIGS. 3 and 4, the preferred embodiment includes a detent mechanism 305 having a biasing spring 308 of generally semi-circular shape that is sized to fit within an internal groove on the underside of the core 304. The spring 308 urges a detent pin 377 to extend outwardly through a radial hole 379 that penetrates a downwardly depending cylindrical skirt 306 of the core 304 and opens into the internal groove on the underside of the core 304. A detent ring 312 is sized to fit around the cylindrical skirt 306 of the core 304. The detent ring 312 includes on its internal surface regularly spaced features, such as vertical grooves 310. The spring 308 biases the detent pin 377 against the vertical grooves 310 to ensure proper engagement of the pin 377 in one of the vertical grooves 310. Rotational movement of the core 304 causes the pin 377 to move out of contact with one groove and into a neighboring groove thereby causing a "click" either audible, or tactile, or both.

The riflescope of the invention may also include sealing devices and other features useful in such riflescopes to minimize the entry of foreign materials and prevent condensation on internal optical surfaces. For example, with further reference to FIGS. 3 and 4, the index tube 348 may also include a circumferential groove 350, within which a contaminant seal 351 is seated for sealing the index tube 348 to the dial 322 to prevent dust, dirt, and other contaminants from entering the adjustment mechanism 106 and damaging the indexing threads 346 or other parts of adjustment mechanism 106. The contaminant seal 351 is preferably an o-ring formed of an elastomeric material, but may be formed by any other suitable sealing material such as, for example, plastic or TEFLON™.

Further, with reference to FIGS. 3 and 4, the adjustment mechanism 106 may include a gas impermeable seal 408 that surrounds an opening 378 of the housing 108 and is positioned between the housing 108 and the core 304 to seal the opening 378 of the housing 108. In the preferred embodiment, a mounting nut 380 retains the core 304 and the adjustment plunger 208 against the housing 108 while the adjustment knob 214, the index tube 348, the annular flange 352, and the spacer 362 can be uncoupled from the core 304 by loosening of the mounting fasteners 330 and 332 to thereby allow all or part of the control assembly 301 to be replaced or substituted with a turning device of a different design, without breaching the gas-impermeable seal 408. A dust seal o-ring 420 is positioned between the mounting nut 380 and the housing 108 to prevent contaminants from entering the plunger mechanism 303.

The adjustment mechanism 106 may also include a feature for setting a "zero" position of the riflescope 100. The dial 322 may be uncoupled from the core 304 by loosening the mounting fasteners 330 and 332 and allowing the user to turn the dial 322 independently of the adjustment plunger 208, core 304, and retaining cap 320. Such uncoupled rotation of the dial 322 allows a shooter to reset the "zero" setting of the adjustment mechanism 106 after the firearm is sighted in at a particular distance.

In the present invention, the core 304 of the adjustment mechanism 106 is preferably an adjustment nut having a threaded internal bore. Alternative embodiments of the adjustment plunger 208 and core 304 may include, for example, screw- and-gear-type linkages, pulley and gear arrangements, rack-and-pinion arrangements, electronic switches and controls, etc. The adjustment mechanism 106 may be embodied as an adjustment mechanism that provides, for example, power magnification, focus control, power adjustment, range adjustments, or control knobs for scopes that have electronic devices, such as battery-powered illuminated reticules. The adjustment mechanism 106 may be fabricated from a hard, wear-resistant material, such as hardened metal, for example, steel, tungsten carbide, and the like.

It will be obvious to those having skill in the art that many changes may be made to the details of the above-described embodiments of this invention without departing from the underlying principles thereof. The scope of the present invention should, therefore, be determined only by the following claims.

What is claimed is:

1. In a riflescope of the type that includes a housing, an adjustable member movably mounted within the housing, and an adjustment mechanism having a core mounted to the housing for rotation about an axis of rotation, the core restricted from moving along the axis of rotation, and the core in operative association with the adjustable member for adjusting the riflescope in response to rotation of the core, the improvement comprising:

an adjustment knob coupled to the core for rotation therewith and extending from the housing a protrusion distance, the adjustment knob prevented from moving along the axis of rotation relative to the core;

an index slide slidably supported on the adjustment mechanism for movement along a slide path extending along the axis of rotation between the adjustment knob and the core, the index slide threadably coupled to the adjustment knob for movement of the index slide along the slide path in response to rotation of the adjustment knob;

a scale including a set of indicia arranged on the adjustment mechanism; and a datum located on the adjustment mechanism, the datum and the scale moving relative to each other in response to the movement of the index slide along the slide path and cooperating to thereby indicate to a user of the riflescope the amount of adjustment of the adjustment mechanism through multiple turns of the adjustment knob without increasing the protrusion distance.

2. The improved riflescope of claim 1, further comprising an adjustment plunger threadably coupled to the core and extending within the interior of the housing toward the adjustable member, the adjustment plunger being restricted from rotating and driven along the axis of rotation in response to rotation of the core.

3. The improved riflescope of claim 1 in which the adjustment knob includes a dial and a retaining cap adjacent the dial, the dial being threadably coupled to the index slide such that rotation of the dial about the axis of rotation causes the index slide to move alone the slide path, and further comprising a fastener for securing the retaining cap to the core, wherein tightening of the fastener causes the retaining cap to frictionally engage the dial for rotation therewith, and wherein loosening of the fastener allows the dial and the retaining cap to be independently rotated for adjusting a zero setting of the adjustment mechanism.

4. The improved riflescope of claim 3, further comprising a fine adjustment scale including multiple indicia spaced apart around the dial.

5. The improved riflescope of claim 1 in which the housing includes an opening through which the adjustment mechanism extends and further comprising:

a gas-impermeable seal surrounding the opening of the housing and positioned between the housing and the adjustment mechanism to seal the opening of the housing.

6. The improved riflescope of claim 5, further comprising a mounting nut that retains the core against the housing to thereby allow the adjustment knob and the index slide to be uncoupled from the core for replacement of the adjustment knob and the index slide without unsealing the opening of the housing.

7. The improved riflescope of claim 1, further comprising a means for providing non-visual sensory feedback to the user when the adjustment knob is rotated, thereby allowing the user to determine the extent of adjustment of the adjustment mechanism without averting his eye from a target viewed through the riflescope.

8. The improved riflescope of claim 1 in which the index slide is an index tube centered on the axis of rotation.

9. The improved riflescope of claim 1, further comprising a flange secured to the housing, the index slide being keyed to the flange for preventing rotation of the index slide around the axis of rotation in response to rotation of the adjustment knob.

10. The improved riflescope of claim 1 in which:

the scale is marked on the index slide; and the adjustment knob includes an edge that overlaps the index slide, the edge serving as the datum.

11. The improved riflescope of claim 1 in which the datum includes a window formed in the index slide and the scale is positioned for viewing through the window.

12. The improved riflescope of claim 9, in which:

the scale is marked on the flange; and the index slide includes an edge that overlaps the flange, the edge serving as the datum.

13. The improved riflescope of claim 2 in which the threaded coupling of the index slide to the adjustment knob has a first pitch and the threaded coupling of the core to the plunger has a second pitch different from the first pitch.

14. The improved riflescope of claim 1 in which rotation of the adjustment knob adjusts an elevation adjustment of the riflescope.

15. A non-telescoping adjustment mechanism for a sighting dice, the sighting device including a housing having an interior and an exterior, and further including an adjustable member positioned within the interior of the housing, the non-telescoping adjustment mechanism comprising:

a core operatively associated with the adjustable member and supported on the housing for rotation about an axis of rotation, the core being mounted such that, when rotated, the core remains stationary along the axis of rotation relative to the housing;

an adjustment knob coupled to the core for rotation therewith and extending from the housing a protrusion distance, the adjustment knob prevented from moving along the axis of rotation relative to the housing;

an index slide slidably supported on the adjustment mechanism for movement along a slide path extending along the axis of rotation between the adjustment knob and the core, the index slide threadably coupled to the adjustment knob for movement of the index slide along the slide path in response to rotation of the adjustment knob;

a scale including a set of indicia arranged on the adjustment mechanism; and a datum located on the adjustment mechanism, the datum and the scale moving relative to each other in response to the movement of the index slide along the slide path and cooperating to thereby indicate to a user of the riflescope the amount of adjustment of the adjustment mechanism through multiple turns of the adjustment knob without increasing the protrusion distance.

16. The adjustment mechanism of claim 15, further comprising an adjustment plunger threadably coupled to the core and extending within the interior of the housing toward the adjustable member, the adjustment plunger being restricted from rotating and driven along the axis of rotation in response to rotation of the core.

17. The adjustment mechanism of claim 15 in which the adjustment knob includes a dial and a retaining cap adjacent the dial, the dial being threadably coupled to the index slide such that rotation of the dial about the axis of rotation causes the index slide to move along the slide path, and further comprising a fastener for securing the retaining cap to the core, wherein tightening of the fastener causes the retaining cap to frictionally engage the dial for rotation therewith, and wherein loosening of the fastener allows the dial and the retaining cap to be independently rotated for adjusting a zero setting of the adjustment mechanism.

18. The adjustment mechanism of claim 17, further comprising a fine adjustment scale including multiple indicia spaced apart around the dial.

19. The adjustment mechanism of claim 15 in which the housing further includes an opening through which the adjustment mechanism extends and farther comprising:

a gas-impermeable seal sized for surrounding the opening of the housing and for positioning between the housing and the adjustment mechanism to seal the opening of the housing.

20. The adjustment mechanism of claim 19, further comprising a mounting nut adapted for securing the core against the housing to thereby allow the adjustment knob and the index slide to be uncoupled from the core for replacement of the adjustment knob and the index slide without unsealing the opening of the housing.

21. The adjustment mechanism of claim 15 in which the adjustment mechanism further comprises a means for providing non-visual sensory feedback to the user when the adjustment knob is rotated, thereby allowing the user to determine the extent of adjustment of the adjustment mechanism without averting his eye from a target.

22. The adjustment mechanism of claim 15 in which the index slide is an index tube centered on the axis of rotation.

23. The adjustment mechanism of claim 15, further comprising a flange adapted to be secured to the housing, the index slide being keyed to the flange for preventing rotation of the index slide around the axis of rotation in response to rotation of the adjustment knob.

24. A riflescope comprising:

an outer tube adapted to be mounted onto a firearm;

an inner tube positioned within the outer tube and having a first end and a second end, the first end pivotally mounted within the outer tube and the second end being displaceable; and an adjustment mechanism including:

a core having an axis of rotation and a set of drive threads centered on the axis of rotation, the core rotatably mounted to the outer tube such that, when rotated, the core remains stationary along the axis of rotation relative to the outer tube;

an adjustment plunger threadably coupled to the set of drive threads of the core and extending within the outer tube to operatively engage the second end of the inner tube, rotation of the core about the axis of rotation causing the adjustment plunger to move along the axis of rotation and to displace the inner tube;

an adjustment knob rigidly coupled to the core for rotation therewith, the adjustment knob restricted from moving along the axis of rotation relative to the housing;

an index slide having a set of indicator threads centered on the axis of rotation, the index slide keyed to prevent rotation of the index slide about the axis of rotation, and the index slide threadably coupled to the adjustment knob such that rotation of the adjustment knob causes the index slide to move along the axis of rotation;

a scale including a set of indicia arranged on the adjustment mechanism; and a datum located on the adjustment mechanism, the datum and the scale moving relative to each other in response to the movement of the index slide along the slide path and cooperating to thereby indicate to a user of the riflescope the amount of adjustment of the adjustment mechanism through multiple turns of the adjustment knob.

* * * * *

UNITED STATES PATENT AND TRADEMARK OFFICE

CERTIFICATE OF CORRECTION

PATENT NO. : 6,691,447 B1
DATED : February 17, 2004
INVENTOR(S) : Rodney H. Otteman It is certified that error appears in the above-identified patent and that said Letters Patent is hereby corrected as shown below:

Column 1,
Line 66, “3600” should read -- 360° --.

Column 9,
Line 65, “alone” should read -- along --.

Column 10,
Line 53, “dice” should read -- device --.

Column 11,
Line 37, “farther” should read -- further --.

Signed and Sealed this

Sixth Day of July, 2004

JON W. DUDAS
*Acting Director of the United States Patent and Trademark Office*